US006581506B1

(12) United States Patent
Shimada

(10) Patent No.: US 6,581,506 B1
(45) Date of Patent: Jun. 24, 2003

(54) METHOD AND DEVICE FOR CONTROLLING SUPPLY OF WORKING FLUID

(75) Inventor: Yoshiyuki Shimada, Tokyo (JP)

(73) Assignee: Shin Caterpillar Mitsubishi Ltd., Setagaya-ku (JP)

( * ) Notice: Subject to any disclaimer, the term of this patent is extended or adjusted under 35 U.S.C. 154(b) by 0 days.

(21) Appl. No.: 09/647,722

(22) PCT Filed: Oct. 27, 1999

(86) PCT No.: PCT/JP99/05934

§ 371 (c)(1),
(2), (4) Date: Dec. 7, 2000

(87) PCT Pub. No.: WO00/46514

PCT Pub. Date: Aug. 10, 2000

(30) Foreign Application Priority Data

Feb. 4, 1999 (JP) ..... 11-27536

(51) Int. Cl.[7] ..... F15B 11/16
(52) U.S. Cl. ..... 91/513
(58) Field of Search ..... 60/424; 91/513

(56) References Cited

U.S. PATENT DOCUMENTS 5,493,950 A * 2/1996 Kim ..... 91/516
5,813,311 A * 9/1998 Toyooka et al. ..... 91/513

* cited by examiner

*Primary Examiner*—F. Daniel Lopez
(74) *Attorney, Agent, or Firm*—Darby & Darby

(57) ABSTRACT

A center bypass line (13) and a parallel line (14) are connected to a hydraulic pump (10). The center bypass line (13) is adapted to sequentially feed working fluid to a plurality of throttling selector valves (28),(15),(16),(29). The parallel line (14) is adapted to independently feed working fluid to the throttling selector valves (28),(15),(16),(29). Between the swing selector valve (15) and the arm-dedicated selector valve (16), a supply port of the arm-dedicated selector valve (16) is connected to a supply line (18) and another supply line (19), which branch off respectively from the center bypass line (13) and the parallel line (14), and a swing priority valve (21) is disposed in the supply line (19). Degree of opening-area of the swing priority valve (21) is pilot-controlled by a pressure reducing valve (31), which is designed such that its delivery pressure (P1) is reduced according to increase in remote control pressure that is used to operate the swing selector valve (15).

6 Claims, 4 Drawing Sheets

METHOD AND DEVICE FOR CONTROLLING SUPPLY OF WORKING FLUID

TECHNICAL FIELD

The present invention relates to a method of controlling supply of working fluid for an ordinary machine or a construction machine. The invention also relates to a control device used for such a method.

BACKGROUND OF THE INVENTION

FIG. 3 shows an example of a hydraulic excavator as a construction machine. The hydraulic excavator has a lower structure 1 and an upper structure 3, which is revolvably attached to the lower structure 1 with a revolving bearing portion 2 therebetween. A front attachment 4 is mounted on the upper structure 3. The front attachment 4 includes a boom 5, an arm 6 and a bucket 7. The base end of the boom 5 is rotatably fitted to the upper structure 3, while the front end of the boom 5 is rotatably attached to the base end of the arm 6. The bucket 7 is rotatably attached to the front end of the arm 6. The boom 5, the arm 6 and the bucket 7 are adapted to be rotated by a boom-cylinder 5*c*, an arm cylinder 6*c* and a bucket cylinder 7*c* respectively.

An example of conventional swing priority circuits is shown in FIG. 4, wherein working fluid is discharged from a hydraulic pump 10. The working fluid is then divided and fed into a center bypass line 13 and a parallel line 14 in a control valve 12, with a relief valve 11 controlling the pressure of the working fluid to a preset pressure.

A throttling selector valve dedicated to swinging motion (hereinafter called the swing selector valve) 15, an arm-dedicated throttling selector valve (hereinafter called the arm-dedicated selector valve) 16, and other throttling selector valves 28,29 are disposed in the control valve 12. The swing selector valve 15 is adapted to control a revolution motor 3*m* for revolving the upper structure to the right or the left. The other throttling selector valves 28,29 are adapted to control other cylinders of the front attachment 4 and the drive motor of the lower structure 1.

The swing selector valve 15 is designed to be pilot-operated by a remote-control valve dedicated to controlling hydraulic pressure for swinging motion and adapted to be manually operated with a swing operating lever. The arm-dedicated selector valve 16 is designed to be pilot-operated by an oil pressure remote-controlling valve that is dedicated to controlling the arm and adapted to be manually operated with another operating lever.

The swing selector valve 15 is disposed upstream from the arm-dedicated selector valve 16, and a supply line 17 that leads to the swing selector valve 15 is connected to the parallel line 14, thereby forming a so-called parallel circuit.

A supply line 18 leading to the arm-dedicated selector valve 16 is connected to the center bypass line 13, thereby forming a so-called tandem circuit.

A supply line 19 extends between the parallel line 14 and the supply line 18, and a swing priority valve 21 is disposed in the supply line 19. The swing priority valve 21 is adapted to be changed over based on external pilot signal pressure fed from a solenoid valve 20, which is of an on/off switching type. When the solenoid valve 20 is off, the external pilot signal pressure that is fed from a pilot pump 22 through the solenoid valve 20 is applied through a pilot line 23 to the swing priority valve 21 and switches said swing priority valve 21 so that the parallel line 14 communicates with the supply line 18. When the solenoid valve 20 is at the 'on' position, the pilot line 23 communicates with a drain line 24 so that the swing priority valve 21 is at the neutral position as shown in the drawing. Therefore, the parallel line 14 and the supply line 18 are cut off from each other.

When the solenoid valve 20 is switched on, the working fluid is fed to the arm cylinder 6*c* solely from the center bypass line 13, because the supply line 19 is blocked by the swing priority valve 21, which is at the neutral position.

Therefore, when the revolution motor 3*m* operates in sync with the arm cylinder 6*c*, the working fluid fed to the arm cylinder 6*c* is limited by means of a bypass notch 25 of the swing selector valve 15, and the working fluid fed to the revolution motor 3*m*, which serves to revolve the upper structure 3, travels from the parallel line 14 to the arm cylinder 6*c* through the supply line 17 and a supply notch 27.

In other words, the fluid is preferentially fed to the swing system. This mechanism is a so-called swing priority circuit, which is particularly effective for, for example, digging a groove by conducting an arm-in operation while pushing the bucket against the wall of the groove with revolving motion.

When the solenoid valve 20 is turned off, the external pilot signal pressure fed from the pilot pump 22 changes over the swing priority valve 21 so that the parallel line 14 communicates with the supply line 18. Therefore, if the solenoid valve 20 is at the 'off' position when the revolution motor 3*m* operates in sync with the arm cylinder 6*c*, swing priority does not work, because the parallel line 14 feeds working fluid to the arm cylinder 6*c*.

According to the prior art described above, the manner of controlling the swing priority valve 21 is on/off control by the solenoid valve 20. Therefore, as described above, in case the swing priority valve 21 is in the blocked state in the swing priority circuit, the bypass notch 25 of the swing selector valve 15 limits the working fluid during the period when the revolution motor 3*m* operates in sync with the arm cylinder 6*c*. Along the nearly entire stroke of the swing selector valve 15, the opening-area of the bypass notch 25 is normally much smaller than the opening-area of the bypass notch 27 as shown in FIG. 5 so as to ensure a sufficient supply of working fluid to the revolution motor 3*m* during swinging operation.

As a result, in cases where there is a change in the degree of operation of the swing operating lever, in other words the distance of shifting the swing selector valve 15, the working fluid fed through the supply line 18 to the arm-dedicated selector valve 16 is considerably reduced by the bypass notch 25 almost regardless of the degree of operation of the swing operating lever. Thus, the working fluid fed to the arm cylinder 6*c* is reduced to an extremely small quantity.

The way a machine is supposed to work is that when the degree of operation of the swing operating lever is increased, the quantity of the hydraulic fluid supplied to the arm cylinder 6*c* should increase accordingly. Likewise, when the degree of operation of the swing operating lever is reduced, the quantity of the hydraulic fluid supplied to the arm cylinder 6*c* should decrease accordingly. In other words, it is desirable that the working fluid fed from the hydraulic pump 10 be effectively and efficiently used. In reality, however, it is difficult with the conventional art to achieve effective use of working fluid. During minute swinging operation, too, the conventional art presents a problem in that large restriction at the bypass notch 25 hinders quick movement of the arm cylinder 6*c*.

In order to solve the above problem, an object of the present invention is to make effective use of working fluid fed from a pump to a plurality of throttling selector valves. Another object of the invention is to make the machine more convenient to operate by ensuring smooth interactive operation among a plurality of hydraulic actuators.

DISCLOSURE OF THE INVENTION

A method of controlling supply of working fluid according to the present invention calls for feeding working fluid from a pump to a plurality of throttling selector valves adapted to respectively control a plurality of hydraulic actuators in such a manner that the working fluid flows through the throttling selector valves in sequence, while feeding working fluid from the pump to one located relatively upstream of the throttling selector valves, i.e. the first throttling selector valve, without passing through any other throttling selector valves and feeding working fluid from the pump to another one located relatively downstream of the throttling selector valves, i.e. the second throttling selector valve, without passing through any other throttling selector valves in such a manner that the quantity of the working fluid fed to the second throttling selector valve is throttle-controlled according to the degree of operation of the first throttling selector valve. According to the structure described above, when the degree of operation of the first throttling selector valve increases, the quantity of the working fluid supplied to the second throttling selector valve is reduced accordingly so that the working fluid fed from the pump is efficiently distributed to the hydraulic actuator controlled by the first throttling selector valve and the hydraulic actuator that is controlled by the second throttling selector valve. Furthermore, even when the first throttling selector valve operates, the structure described above prevents radical change in quantity of the hydraulic fluid fed to the second throttling selector valve, thereby ensuring smooth interactive operation among a plurality of hydraulic actuators and consequently making the machine more convenient to operate.

According to another feature thereof, the invention relates to a method of controlling supply of working fluid in a construction machine having a plurality of hydraulic actuators that comprise at least actuators of a revolving system and actuators of a working equipment system, said method calling for feeding working fluid from a pump to a plurality of throttling selector valves adapted to respectively control the aforementioned plurality of hydraulic actuators in such a manner that the working fluid flows through the throttling selector valves in sequence, while feeding working fluid from the pump to one of the throttling selector valves, i.e. a throttling selector valve located relatively upstream and dedicated to the revolving system, without passing through any other throttling selector valves and feeding working fluid from the pump to another one of the throttling selector valves, i.e. a throttling selector valve located relatively downstream and dedicated to the working equipment system, without passing through any other throttling selector valves in such a manner that the quantity of the working fluid fed to the throttling selector valve dedicated to the working equipment system is throttle-controlled according to the degree of operation of the throttling selector valve dedicated to the revolving system. According to the structure described above, when the throttling selector valve of the revolving system of a construction machine such as a hydraulic excavator is minutely operated, a sufficient quantity of working fluid is fed to the throttling selector valve dedicated to the working equipment system so that the working equipment can quickly be moved while minute revolution is underway. Thus, the construction machine is made more convenient to operate.

A working fluid supply control device according to the invention includes a pump adapted to discharge working fluid; a plurality of hydraulic actuators adapted to be operated by the working fluid; a plurality of throttling selector valves for respectively controlling the working fluid fed from the pump to said plurality of hydraulic actuators; a center bypass line for sequentially supplying said plurality of throttling selector valves with the working fluid discharged from the pump; a parallel line for independently supplying said plurality of throttling selector valves in sequence with the working fluid discharged from the pump; a supply line branching off from the center bypass line at a point between the first throttling selector valve, which is one of the aforementioned throttling selector valves, and the second throttling selector valve, which is a separate and different one of the throttling selector valves and located downstream from said first throttling selector valve, said supply line connected to a supply port of the second throttling selector valve; a separate and different supply line branching off from the parallel line and connected to the supply port of the second throttling selector valve; a priority valve disposed in the aforementioned separate and different supply line and designed such that the degree of opening-area of the priority valve can be so adjusted as to give priority to the quantity of the hydraulic fluid fed to the first throttling selector valve over the quantity of the hydraulic fluid fed to the second throttling selector valve; and a control means adapted to steadily adjust the priority valve from the fully open state to the fully closed state in accordance with degree of operation of the first throttling selector valve. With the structure as above, even when the hydraulic fluid fed from the center bypass line through one supply line, i.e. the earlier mentioned one of the two supply lines, to the supply port of the second throttling selector valve is reduced with the center bypass line throttled down by operation of the first throttling selector valve, the quantity of the hydraulic fluid fed from the parallel line through the other supply line to the supply port of the second throttling selector valve is automatically controlled by the priority valve that is steadily adjusted from the open state to the closed state by the control means according to degree of operation of the first throttling selector valve. Thus, the working fluid fed from the pump can efficiently be utilized as it is completely distributed to the hydraulic actuator controlled by the first throttling selector valve and the hydraulic actuator controlled by the second throttling selector valve, while radical change in the quantity of working fluid fed to the second throttling selector valve is prevented from occurring during operation of the first throttling selector valve. Therefore, a device according to the invention ensures smooth interactive operation among a plurality of hydraulic actuators and makes the machine more convenient to operate.

According to yet another feature of the invention, the aforementioned first throttling selector valve of the working fluid supply control device is a swing-dedicated throttling selector valve for controlling swinging motion of a hydraulic excavator; the second throttling selector valve is an arm-dedicated throttling selector valve for controlling action of the arm of a hydraulic excavator; and the priority valve is a swing priority valve for giving priority to swinging motion over action of the arm. With the structure as above, a sufficient quantity of working fluid can be fed through the swing priority valve to the arm-dedicated throttling selector valve of the hydraulic excavator when the swing-dedicated throttling selector valve is minutely operated. Therefore, the structure described above makes the hydraulic excavator more convenient to operate, because the hydraulic actuator for the arm can be moved rapidly even during minute swinging operation.

According to yet another feature of the invention, the swing priority valve of the working fluid supply control device is a pilot-operated throttle valve which is adapted to gradually open from the fully closed position, where the spring is at the return position, in accordance with increase of external pilot signal pressure; and the control means is a pilot-operated pressure reducing valve adapted to be controlled in such a manner that its outlet pressure, which serves as external pilot signal pressure applied to the priority valve, is reduced according to increase in remote control pressure for pilot-operating the first throttling selector valve. With the structure as above, the outlet pressure of the pilot-operated pressure reducing valve serving as the control means is reduced according to increase in remote control pressure for pilot-operating the first throttling selector valve, and the outlet pressure serving as an external pilot signal pressure works on the pilot-operated throttle valve serving as the priority valve so that the priority valve is gradually closed from the fully open state to the fully closed state, where the spring is at the return position, in accordance with reduction of the external pilot signal pressure. By solely using an inexpensive pilot pressure circuit, the structure described above is capable of controlling distribution of an appropriate quantity of hydraulic fluid from the priority valve to the second throttling selector valve in accordance with degree of operation of the first throttling selector valve.

PREFERRED EMBODIMENT OF THE INVENTION

Figure 1:
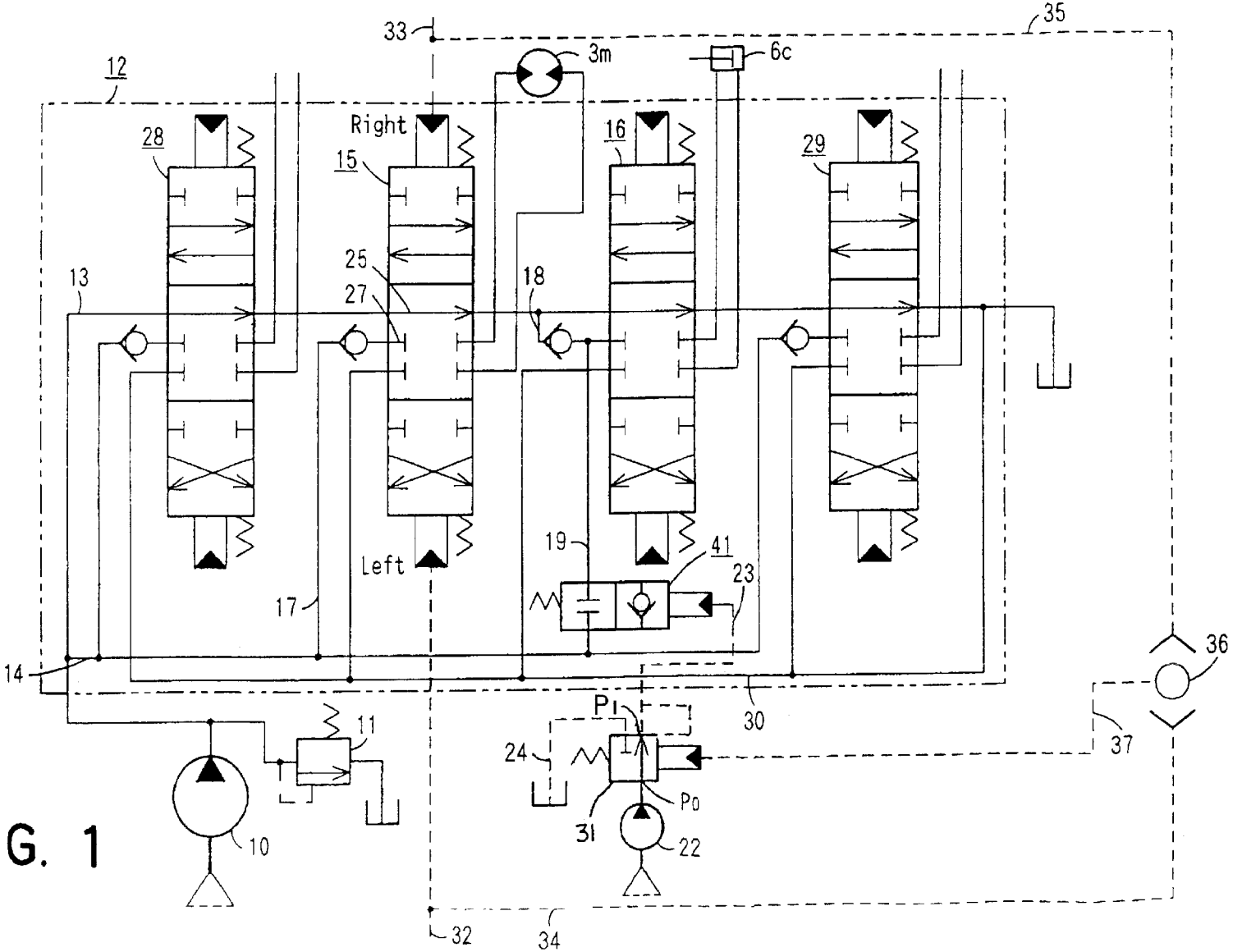
FIG. 1 is a circuit diagram of a control device for controlling supply of working fluid according to an embodiment of the present invention.
Figure 2:
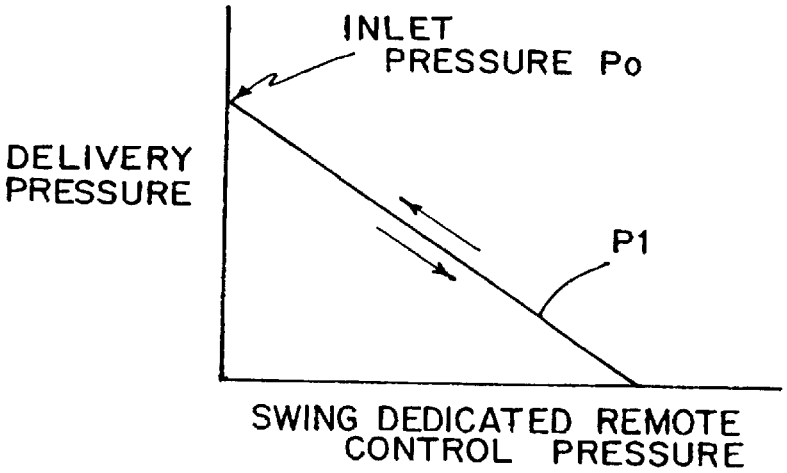
FIG. 2 is a characteristic diagram showing operation characteristics of a pilot-operated pressure reducing valve used in said control device.
Figure 3:
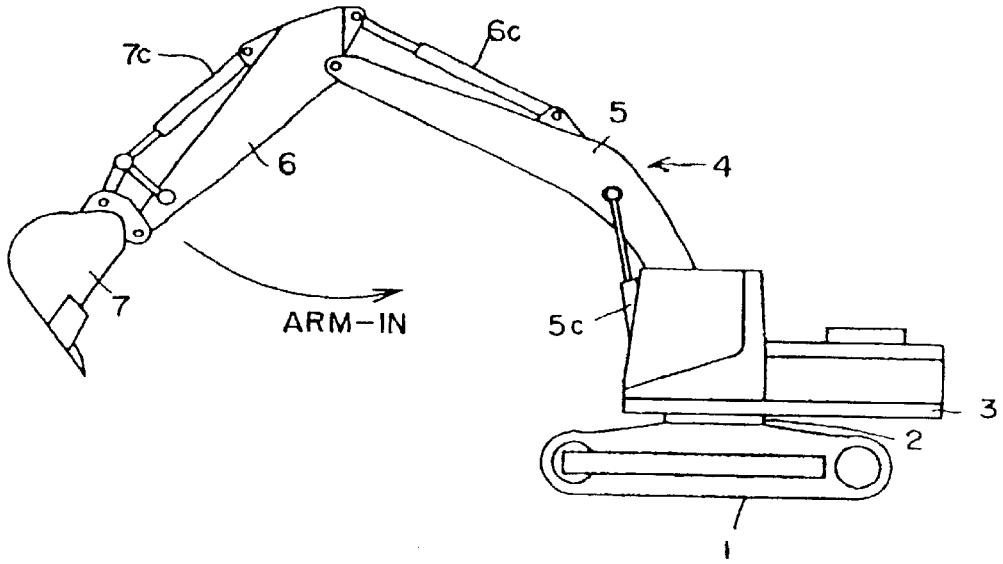
FIG. 3 PRIOR ART
FIG. 3 is a side view of a hydraulic excavator as a construction machine.
Figure 4:
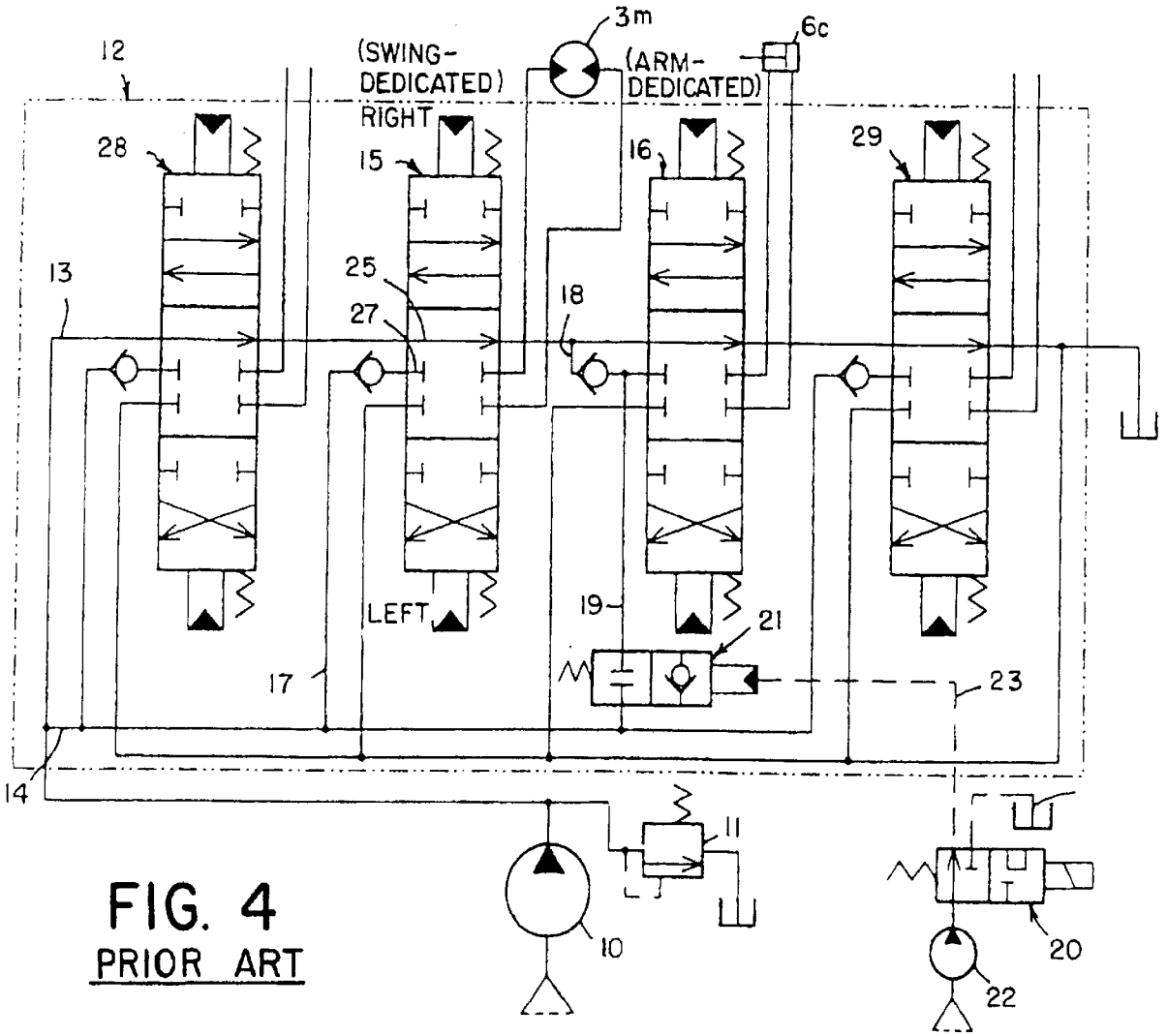
FIG. 4 PRIOR ART
FIG. 4 is a hydraulic circuit diagram of a conventional control device for controlling supply of working fluid.
Figure 5:
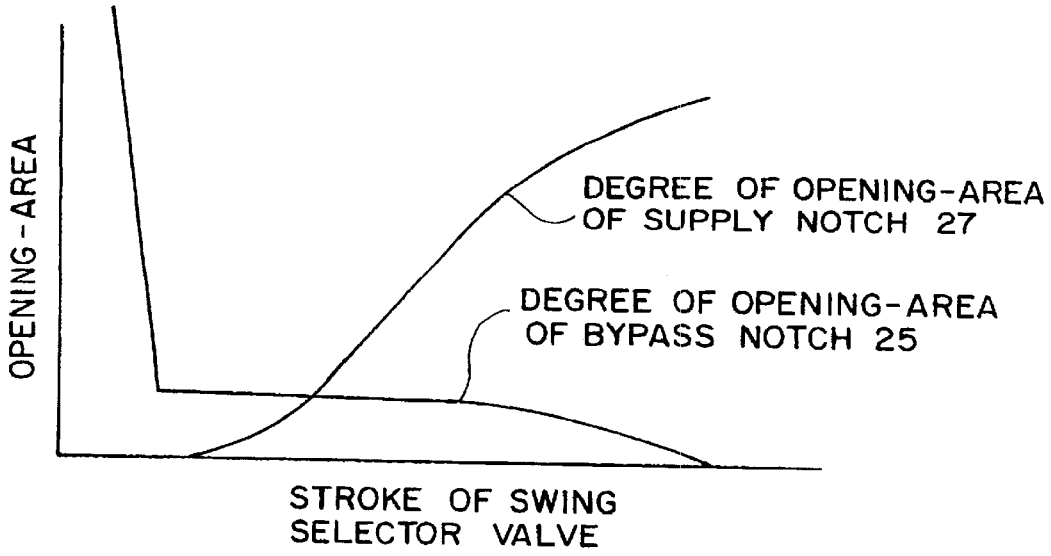
FIG. 5 PRIOR ART
FIG. 5 is a characteristic diagram showing opening characteristics of a swing selector valve used in said conventional control device.

Next, an embodiment of the present invention is explained hereunder, referring to FIGS. 1 through 3. In the description hereunder, elements and components similar to those of the conventional device shown in FIG. 4 are identified with the same reference numerals (11–29), explanation of which may be omitted.

FIG. 1 shows an example of swing priority circuits, wherein a control valve 12 is connected to a hydraulic pump 10, which is a pump installed in a hydraulic excavator. The control valve 12 contains a plurality of throttling selector valves adapted to control respectively working fluid fed from the hydraulic pump 10 to a plurality of hydraulic actuators that operate movable elements of the hydraulic excavator, such as the lower structure 1, the upper structure 3, the boom 5, the arm 6 and the bucket 7.

The aforementioned plurality of hydraulic actuators comprise a drive motor (not shown), a revolution motor 3*m*, a boom cylinder 5*c*, an arm cylinder 6*c* and a bucket cylinder 7*c* or the like. The throttling selector valves mentioned above are spool valves which are respectively adapted to control the directions and the flow rates of the working fluid fed to these hydraulic actuators.

The present embodiment includes a swing throttling selector valve (hereinafter called swing selector valve) 15 adapted to control swinging motions of the hydraulic excavator by controlling the working fluid fed to the revolution motor 3*m*. Said swing selector valve 15 is referred to as the first throttling selector valve in the claims and other parts of this specification. An arm-dedicated throttling selector valve (hereinafter called arm-dedicated selector valve) 16 serving as the second throttling selector valve referred to in the claims and other parts of this specification is disposed downstream from the swing selector valve 15 and adapted to control action of the arm of the hydraulic excavator by controlling the working fluid fed to the arm cylinder 6*c*. Furthermore, other throttling selector valves 28,29, which are adapted to commonly receive working fluid from the hydraulic pump 10, are disposed upstream from the swing selector valve 15 and downstream from the arm-dedicated selector valve 16 respectively.

A center bypass line 13, a parallel line 14 and a tank line 30, too, are provided in the control valve 12. The center bypass line 13 is adapted to sequentially supply the selector valves 28,15,16,29 with working fluid discharged from the hydraulic pump 10. The parallel line 14 branches off from the center line 14 and adapted to feed working fluid discharged from the hydraulic pump 10 to the selector valves 28,15,16,29 independently from the center bypass line 13. The tank line 30 communicates with an oil tank.

Between the swing selector valve 15 and the arm-dedicated selector valve 16, a supply line 18, which branches off from the center bypass line 13, is connected to a supply port of the arm-dedicated selector valve 16, while another supply line 19, which branches off from the parallel line 14, is also connected to the supply port of the arm-dedicated selector valve 16.

A swing priority valve 41 that serves as a priority valve to give priority to swinging motion over arm movement is disposed in the supply line 19. The swing priority valve 41 is a pilot-operated throttle valve designed such that in accordance with increase in external pilot signal pressure the valve gradually opens from the fully closed state, where the spring is at the original, returned position. Thus, a quantity of working fluid fed to the swing selector valve 15 is given priority over a quantity of working fluid fed to the arm-dedicated selector valve 16 by adjusting the opening of the swing priority valve 41.

Instead of a conventional solenoid valve 20 shown in FIG. 4, a pilot-operated pressure reducing valve (hereinafter simply called the pressure reducing valve) 31 is disposed in a pilot line 23, between the swing priority valve 41 and a pilot pump 22 which serves to supply the swing priority valve 41 with pilot pressure. Said pressure reducing valve 31 serves as a control means for steadily controlling the swing priority valve 41 from the open position to the closed position in accordance with the degree of operation of the swing selector valve 15.

The pressure reducing valve 31 is designed to be controlled based on swing-dedicated remote control pressure output from a swing operating valve (not shown) to pilot lines 32,33 of the swing selector valve 15. Said swing operating valve is an oil pressure remote-control valve dedicated to controlling hydraulic pressure for swinging motion and adapted to be operated by the operator of the hydraulic excavator by using a lever. Pilot lines 34,35 branch off respectively from the pilot lines 32,33, which extend from the remote-control valve dedicated to controlling hydraulic pressure for swinging motion and serve to pilot-control the swing selector valve 15. The pilot lines 34,35 communicate with a pilot chamber of the pressure reducing valve 31, via a shuttle valve 36 and a pilot line 37. Because of the shuttle valve 36, pilot pressure generated in either pilot line 34/35 is applied to the pressure reducing valve 31 through the pilot line 37.

As shown in FIG. 2, the pressure reducing valve 31 is controlled in such a manner that its delivery pressure P1, which serves as the external pilot signal pressure applied to the swing priority valve 41, is reduced according to degree of pilot operation of the swing selector valve 15, in other words increase in swing-dedicated remote control pressure which is used to pilot-operate the swing selector valve 15. As the pressure reducing valve 31 is designed such that its inlet pressure P0 from the pilot pump 22 is reduced to inverse proportion to swing-dedicated remote control pressure and output as delivery pressure P1, the pressure reducing valve 31 automatically and steadily adjusts the swing priority valve 41 from the fully open state to the fully closed state by means of delivery pressure P1 which is gradually reduced.

To be more specific, when the swing-dedicated remote control pressure of the swing selector valve 15 changes from low to high, delivery pressure P1 of the pressure reducing valve 31 is gradually reduced accordingly. As a result, the swing priority valve 41, on which the delivery pressure P1 works as external pilot signal pressure, is gradually closed from the fully open state in accordance with the decrease of the delivery pressure P1 so that the working fluid fed through the swing priority valve 41 to the arm-dedicated selector valve 16 is gradually throttled down.

When the swing selector valve 15 starts up, the center bypass line 13 is substantially narrowed by means of the bypass notch 25 of the swing selector valve 15 so that the quantity of the working fluid fed from the supply line 18 to the supply port of the arm-dedicated selector valve 16 is drastically reduced. However, because of the function of the pressure reducing valve 31 described above, a sufficient quantity of working fluid is ensured to be fed from the parallel line 14 through the swing priority valve 41 and the supply line 19 to the supply port of the arm-dedicated selector valve 16. Therefore, there is no possibility of radical reduction in the quantity of working fluid fed to the arm-dedicated selector valve 16 occurring during minute swinging operation.

Thus, the working fluid supplied from the hydraulic pump 10 is efficiently used as it is steadily and efficiently distributed to the revolution motor 3*m,* and the arm cylinder 6*c,* which are controlled by the swing selector valve 15 and the arm-dedicated selector valve 16 respectively. Furthermore, as the hydraulic fluid distributed from the swing priority valve 41 to the arm-dedicated selector valve 16 can gradually be reduced from the maximum flow rate in accordance with the degree of operation of the swing selector valve 15, smooth interactive operation is ensured among a plurality of hydraulic actuators. Thus, operation of the machine is made more effective.

To be more specific, when the swing selector valve 15 of the hydraulic excavator is minutely operated, a sufficient quantity of working fluid is fed through the swing priority valve 41 to the arm-dedicated selector valve 16, thereby allowing the arm 6 to be quickly moved while minute swinging operation is underway. Thus, the machine is made more convenient in such an operation as digging a groove with the front attachment 4.

Next, the function of the embodiment shown in FIGS. 1 and 2 is explained.

Referring to FIG. 1, when remote control pressure of the swing selector valve 15 is applied to either pilot line 34 or 35 during operation for lateral revolution, the remote control pressure passes through the corresponding pilot line 34 or 35 and is applied to the pressure reducing valve 31 via the shuttle valve 36 and the pilot line 37 so that the external pilot signal pressure applied to the swing priority valve 41 is reduced according to the remote control pressure of the swing selector valve 15 as indicated in characteristics shown in FIG. 2.

For example, when remote control pressure of the swing selector valve 15 changes from low to high, external pilot signal pressure to the swing priority valve 41 changes from high to low. Therefore, when the swing operation lever is gradually engaged, the switching pressure to the swing priority valve 41 gradually decreases so that the swing priority valve 41 is gradually closed from the fully open state. When the swing operation lever is shifted to the maximum operating position, the swing priority valve 41 is fully closed. In other words, according to degree of operation of the swing operation lever, the quantity of hydraulic fluid fed from the parallel line 14 to the supply line 19 of the arm cylinder 6*c* can easily be controlled by using the swing priority valve 41.

Therefore, in cases where the degree of operation of the swing operation lever gradually changes from small to large during conjunctional movement of the revolution motor 3*m* and the arm cylinder 6*c,* the quantity of oil fed from the supply line 19 to the arm cylinder 6*c* gradually changes from a great quantity to a small quantity. As the hydraulic fluid fed from the hydraulic pump 10 is thus always utilized effectively, the embodiment is free from the problem of "not capable of rapidly moving the arm during minute swinging operation", which problem is common to conventional arts. In other words, the invention provides a variable swing priority circuit which is capable of appropriately controlling the degree of priority given to swinging motion according to degree of operation of the swing operation lever.

As described above, instead of conventional on/off control of the swing priority valve 41 by switching a solenoid valve, the swing priority circuit of a hydraulic excavator of an oil pressure remote-control type according to the invention includes a pilot-operated pressure reducing valve 31 which is disposed in the pilot line 23 of the swing priority valve 41 and adapted to be controlled by remote control pressure dedicated to lateral swing motion, which pressure is fed from a remote-control value dedicated to controlling hydraulic pressure for swinging motion. As a result of such a configuration, the present invention provides a variable-type swing priority circuit which is capable of making the machine easier to maneuver by appropriately controlling the degree of priority given to swinging motion according to degree of operation of the swing operation lever.

According to the embodiment described above, the aforementioned swing priority valve 41 is disposed in the swing priority circuit adapted to give priority to the swing selector valve 15, which serves as the first throttling selector valve, over the arm-dedicated selector valve 16 serving as the second throttling selector valve. However, the swing priority valve 41 may be disposed in a circuit that is adapted to given priority to the first throttling selector valve that is not the swing selector valve 15 over another throttling selector valve that is not the arm-dedicated selector valve 16.

POSSIBLE INDUSTRIAL APPLICATION

A method and a device for controlling supply of working fluid according to the invention are applicable to not only a hydraulic excavator but also construction machines of other types, such as a bulldozer, a loader, or the like. The invention is also applicable to an ordinary machine of a wide variety of types wherein a plurality of hydraulic actuators are respectively controlled by a plurality of throttling selector valves.

What is claimed is:

1. A method of controlling supply of working fluid, which method calls for:

feeding working fluid from a pump to a plurality of pilot-operated throttling selector valves adapted to respectively control a plurality of hydraulic actuators in such a manner that the working fluid flows through the throttling selector valves in sequence;

feeding working fluid from the pump to a first throttling selector valve without passing through any other throttling selector valves;

feeding working fluid from the pump to a second throttling selector valve without passing through any other throttling selector valves in such a manner that the quantity of the working fluid fed to the second throttling selector valve is throttle-controlled according to the degree of operation of the first throttling selector valve;

reducing external pilot signal pressure applied to a priority valve which is located between the pump and the second throttling selector valve, according to increase in remote control pressure for pilot-operating the first throttling selector valve when the remote control pressure is increased; and giving priority to the quantity of the hydraulic fluid fed from the pump to the first throttling selector valve over the quantity of the hydraulic fluid fed from the pump to the second throttling selector valve, by controlling the priority valve according to the reduction of the external pilot signal pressure.

2. A method of controlling supply of working fluid in a construction machine having a plurality of hydraulic actuators that include at least actuators of a revolving system and actuators of a working equipment system, which method calls for:

feeding working fluid from a pump to a plurality of pilot-operated throttling selector valves adapted to respectively control said plurality of hydraulic actuators in such a manner that the working fluid flows through said throttling selector valves in sequence;

feeding working fluid from the pump to one of the throttling selector valves located relatively upstream and dedicated to the revolving system, without passing through any other throttling selector valves;

feeding working fluid from the pump to another one of the throttling selector valves located relatively downstream and dedicated to the working equipment system, without passing through any other throttling selector valves in such a manner that the quantity of the working fluid fed to the throttling selector valve dedicated to the working equipment system is throttle-controlled according to the degree of operation of the throttling selector valve dedicated to the revolving system;

reducing external pilot signal pressure applied to a priority valve which is located between the pump and the throttling selector valve dedicated to the working equipment system, according to increase in remote control pressure for pilot-operating the throttling selector valve dedicated to the revolving system when the remote control pressure is increased; and giving priority to the quantity of the hydraulic fluid fed from the pump to the throttling selector valve dedicated to the revolving system over the quantity of the hydraulic fluid fed from the pump to the throttling selector valve dedicated to the working equipment system, by controlling the priority valve according to the reduction of the external pilot signal pressure.

3. A fluid supply device, comprising:

at least a first and a second valve respectfully controlling a fluid supply to a plurality of actuators of a type actuated by said fluid;

a bypass line sequentially supplying said at least first and second valves with said fluid;

a parallel line independently supplying said at least first and second valves with said fluid;

a first supply line connecting said parallel line to said first valve;

a second supply line connecting said bypass line to said parallel line between said first and second valves;

a priority valve disposed in said second supply line being of a type adjustable to control said fluid to said first valve through said parallel line; and means for controlling said priority valve wherein said priority valve closes in accordance with a reduction of an external pilot signal pressure, wherein the quantity of said fluid fed to said first valve is given priority over the quantity of said fluid fed to said second valve.

4. A fluid supply device according to claim 3, wherein said controlling means comprises:

a third valve having an outlet pressure;

said outlet pressure controlling said priority valve;

a fourth valve receiving an external signal responsive to an operation of said first valve; and said fourth valve controlling said third valve in response to said external signal.

5. A working fluid supply control device comprising:

a pump adapted to discharge working fluid;

a plurality of hydraulic actuators adapted to be operated by the working fluid;

a plurality of throttling selector valves for respectively controlling the working fluid fed from the pump to said plurality of hydraulic actuators;

a center bypass line for sequentially supplying said plurality of throttling selector valves with the working fluid discharged from the pump;

a parallel line for independently supplying said plurality of throttling selector valves in sequence with the working fluid discharged from the pump;

a supply line branching off from the center bypass line at a point between a first throttling selector valve, which is one of the aforementioned throttling selector valves, and a second throttling selector valve, which is a separate and different one of the throttling selector valves and located downstream from said first throttling selector valve, said supply line connected to a supply port of the second throttling selector valve;

a separate and different supply line branching off from the parallel line and connected to the supply port of the second throttling selector valve;

a priority valve disposed in said separate and different supply line and designed such that the degree of opening area of the priority valve is adjusted as to give priority to the quantity of the hydraulic fluid fed to the first throttling selector valve over the quantity of the hydraulic fluid fed to the second throttling selector valve;

a control means adapted to steadily adjust the priority valve from the fully open state to the fully closed state in accordance with the degree of operation of the first throttling selector valve;

the priority valve is a pilot operated throttle valve which is adapted to gradually open from the fully closed position in accordance with increase of external pilot signal pressure; and the control means is a pilot operated pressure reducing valve adapted to be controlled in such a manner that its outlet pressure, which serves as external pilot signal pressure applied to the priority valve, is reduced according to increase in remote control pressure for pilot operating the first throttling selector valve wherein the priority valve is spring biased to the closed position.

6. A working fluid supply control device as claimed in claim 5, wherein:

the first throttling selector valve of is a swing dedicated throttling selector valve for controlling swinging motion of a hydraulic excavator;

the second throttling selector valve is an arm dedicated throttling selector valve for controlling action of the arm of a hydraulic excavator; and the priority valve is a swing priority valve for giving priority to swinging motion over action of the arm.

* * * * *